US005516001A

United States Patent [19]

Muckenfuhs et al.

[11] Patent Number: 5,516,001

[45] Date of Patent: May 14, 1996

[54] APPARATUS FOR SEQUENTIAL DISPENSING OF TISSUES AND PROCESS OF DISPENSING TISSUES USING SUCH AN APPARATUS

[75] Inventors: Delmar R. Muckenfuhs, Middletown; Jane L. Bavely, Cincinnati, both of Ohio

[73] Assignee: The Procter & Gamble Company, Cincinnati, Ohio

[21] Appl. No.: 399,803

[22] Filed: Mar. 7, 1995

[51] Int. Cl.[6] ..... B65H 1/00

[52] U.S. Cl. ..... 221/63; 206/449

[58] Field of Search ..... 221/63, 48, 33; 206/449, 494, 812, 813

[56] References Cited

U.S. PATENT DOCUMENTS

| | | | |
|---|---|---|---|
| 2,890,791 | 6/1959 | Wenzel | 206/57 |
| 3,007,605 | 11/1961 | Donovan | 221/47 |
| 3,021,002 | 2/1962 | Guyer | 206/57 |
| 3,161,336 | 12/1964 | Loescher | 225/106 |
| 3,172,563 | 3/1965 | Harwood | 221/48 |
| 3,239,097 | 3/1966 | Bates et al. | 221/48 |
| 3,372,837 | 3/1968 | Neumann | 221/34 |
| 3,576,243 | 4/1971 | Trunick | 221/63 |
| 3,679,094 | 7/1972 | Nissen et al. | 221/50 |
| 3,679,095 | 7/1972 | Nissen et al. | 221/50 |
| 3,795,355 | 3/1974 | Gerstein | 225/106 |
| 3,881,632 | 5/1975 | Early et al. | 221/50 |
| 3,982,659 | 9/1976 | Ross | 221/63 |
| 4,200,200 | 4/1980 | Hein, III et al. | 221/48 |
| 4,328,907 | 5/1982 | Beard | 221/63 |
| 4,458,810 | 7/1984 | Mahoney | 206/210 |
| 4,478,354 | 10/1984 | Notheis | 221/34 |
| 4,526,291 | 7/1985 | Margulies | 221/63 |
| 4,574,952 | 3/1986 | Masui | 206/494 |
| 4,623,074 | 11/1986 | Dearwester | 211/48 |
| 4,681,240 | 7/1987 | Wyant | 221/48 |
| 4,848,575 | 7/1989 | Nakamura et al. | 206/449 |
| 4,859,518 | 8/1989 | Schutz | 428/126 |
| 4,963,406 | 10/1990 | Gooding, Jr. et al. | 428/43 |
| 5,118,554 | 6/1992 | Chan et al. | 428/126 |
| 5,137,173 | 8/1992 | Hughes et al. | 221/34 |
| 5,219,421 | 6/1993 | Tipping | 221/63 |
| 5,316,177 | 5/1994 | Boldt | 221/63 |

*Primary Examiner*—Kenneth Noland

*Attorney, Agent, or Firm*—Larry L. Huston; E. Kelly Linman; Jacobus C. Rasser

[57] ABSTRACT

A tissue package comprising a dispensing package and tissues. The dispensing package has a dispensing opening. The dispensing opening has a large aperture and an arcuately shaped smaller aperture which are spaced apart and connected by an isthmic connection. Tissues may be easily withdrawn by the user through the large aperture, and fed through the isthmic connection to small aperture. Thereafter, the tissues may be dispensed through the small aperture in a pop-up mode.

18 Claims, 3 Drawing Sheets

APPARATUS FOR SEQUENTIAL DISPENSING OF TISSUES AND PROCESS OF DISPENSING TISSUES USING SUCH AN APPARATUS

FIELD OF THE INVENTION

This invention relates to a dispensing package for tissues. More particularly, the present invention relates to sequential dispensing tissue packages, in which the tissues are provided in individual sheets and can pop-up above the top of the dispenser when the preceding tissue is removed.

BACKGROUND OF THE INVENTION

Tissues are well known in the art. Tissues, such as facial tissues, are commonly used for blowing one's nose, cleaning tasks, etc. Tissues can also be used as paper towels for wiping, cleanup tasks, etc. Tissues, and their packaging, must be inexpensive and disposable, to be widely consumer accepted. Tissues may be supplied dry, with lotion, or moistened. Such tissues are typically generally rectangular in shape and supplied in discrete sheets. Tissues are typically supplied in a generally parallelepipedly shaped box or dispenser. The dispenser has an opening, typically at the top, through which individual sheets are removed by the user.

Early tissue dispensers were of the "reach-in type." The user had to insert his or her fingers through the dispensing opening, grasp a tissue, and pull it out through the dispensing opening. Examples of reach-in dispensers, and improvements thereto, can be found in U.S. Pat. Nos. 3,021,002 issued Feb. 13, 1962 to Guyer; commonly assigned 3,576,243 issued Apr. 27, 1971 to Trunick; and 4,458,810 issued Jul. 10, 1984 to Mahoney.

Over time, the desire for increased convenience led to sequential or pop-up dispensers. In a "pop-up" dispenser, a tissue usually extends through the dispensing opening to an elevation above that of the dispenser package. The user simply grasps the exposed portion of the tissue, without the necessity of inserting fingers through the dispensing opening. In pop-up dispensing, each tissue has a leading portion which is first to pass through the dispensing opening, and a trailing portion which later passes through the dispensing opening. Typically the trailing portion of a first tissue to be dispensed overlaps the leading portion of the next tissue to be dispensed. The overlap is measured generally parallel to the direction of withdrawal of the tissues through the dispensing opening. The overlap is usually, but not necessarily, the same for each tissue and constant throughout the width of each tissue. As the first tissue is withdrawn by the user, the leading portion of the next tissue is pulled through the opening, for later dispensing.

Typically the sequential withdrawal of the succeeding tissue through the dispensing opening occurs due to interfolding of adjacent tissues. The tissues are folded against one another in a variety of configurations, so that the friction of the trailing portion of the withdrawn sheet against the succeeding sheet pulls the leading portion of the succeeding sheet through the dispensing opening. Examples of various interfolding arrangements are found in U.S. Pat. Nos. 3,007,605 issued Nov. 7, 1961 to Donovan; 3,172,563 issued Mar. 9, 1965 to Harwood; 3,679,094 and 3,679,095 both issued Jul. 25, 1972 to Nissen et al.; commonly assigned 3,881,632 issued May 6, 1975 to Early et al; 4,859,518 issued Aug. 22, 1989 to Schutz; and 5,118,554 issued Jun. 2, 1992 to Chan et al.

However, apparatuses for interfolding are both complex and expensive. Purchasing the apparatus represents a significant capital outlay which is ultimately passed on to the consumer of the interfolded tissues. Even when interfolding is properly accomplished, the tissue to be dispensed frequently falls back through the dispensing opening. This problem is exacerbated with relatively tall dispensing packages which are often consumer preferred for economy sized packages. The usable height of the dispensing package is often limited to the length of the overlap of the interfolded tissues. This limitation occurs due to the leading and trailing portions of adjacent tissues unfolding inside a package taller than the overlap, then the second tissue falls back into the package.

Potential solutions to the fallback problem result in additional expenses when trying to dispense interfolded tissues. For example, the prior art has suggested outlining the dispensing opening, to prevent improper dispensing. Yet other attempts in the art have disposed adhesive on the film outlining the dispensing opening. Still further attempts in the art replace the film with paper, for environmental reasons. Of course, such film, adhesive, and paper all represent yet additional costs which are passed on to the consumer of the interfolded tissues. Examples of such attempts in the art are U.S. Pat. Nos. 3,007,605 issued Nov. 7, 1961 to Donovan; 3,239,097 issued Mar. 8, 1966 to Bates et al.; 4,200,200 issued Apr. 29, 1980 to Hein, III et al.; 4,681,240 issued Jul. 21, 1987 to Wyant; and 5,316,177 issued May 31, 1994 to Boldt.

Attempts to improve pop-up dispensing packages also include attachment of the tissues to the removable top of the box, so that the first tissue is pulled through the dispensing opening when the box is opened. Still another attempt in the art provides a lapping flap which allegedly holds partially dispensed sheets against falling back into the cannon. A commercially successful improvement is the dual mode dispensing package which allows for either pop-up or reach-in dispensing. Examples of such attempts in the art include U.S. Pat. Nos. 2,890,791 issued Jun. 16, 1959 to Wenzel; 4,574,952 issued Mar. 11, 1986 to Masui; and commonly assigned 4,623,074 issued Nov. 18, 1986 to Dearwester.

One problem frequently encountered in the pop-up dispensing packages of the prior art is the transition from the reach-in dispensing mode in which the product is shipped to the pop-up dispensing mode which is preferred by the consumer. The dispensing opening must be large enough to allow the consumer to reach his or her fingers therethrough to grasp the tissue and begin the pop-up dispensing process. However, the dispensing opening must be small enough to constrict the tissues dispensed therethrough, so that a tissue may be separated from the succeeding tissues.

One attempt to resolve the diametrically opposed needs for large and small dispensing openings has been to make a dispensing opening which is self threading. In these attempts, the large and small dispensing openings are interconnected such that the smaller dispensing opening is contiguous the larger opening. In these attempts, the user reaches through the larger dispensing opening, grasps the tissue, pulls it through the dispensing opening, and threads it into the smaller dispensing opening. The user then separates the grasped tissue from the succeeding tissue. When the succeeding tissue is needed, it is likewise dispensed and separated from the next succeeding tissue.

One significant drawback to this attempt is that the small opening does not provide sufficient frictional engagement with the tissues to prevent them from falling back into the package. This problem is exacerbated with relatively tall dispensing packages which are often consumer preferred for economy sized packages. The usable height of the dispensing package is often limited to the length of the overlap of the interfolded tissues. If the tissues are not interfolded, but rather are connected by perforations, the magazine of tissues in the taller package will eventually become depleted, or nearly so. As fewer tissues remain in the bottom of a tissue package, a greater portion of the tissue hangs from the dispensing opening to the top of the magazine at the bottom of the package. When this occurs, the weight of the free portion of the tissue increases, making it more likely that the frictional engagement with the dispensing opening is insufficient to prevent the tissue from falling back into the dispensing package. When fallback occurs, the user is frustrated by not only having to reach through the dispensing opening to retrieve the tissue and start the pop-up dispensing process all over again, but is doubly frustrated because the tissue is well below the dispensing opening, having fallen to nearly the bottom of the dispensing package.

Another attempt in the art uses large and small apertures at the ends of a slit-like portion. This particular attempt suffers from the drawback that the shape of both apertures is round.

Examples of such attempts in the art include U.S. Pat. Nos. 4,328,907 issued May 11, 1982 to Beard; and 4,848,575 issued Jul. 18, 1989 to Nakamura et al.

Yet other attempts in the art show a tissue box having three slits, a longitudinally oriented slit emanating from a large opening and which terminates at lateral slits. The longitudinal slit is flanked by two arcuately shaped peripheral slits in order to create hinges. The drawback to this arrangement is that the large wings formed by the hinges occupy an excessively large area of the top of the dispensing package. Yet another teaching in the art shows a dispensing opening tapering to a single slit which intercepts a second slit transverse thereto. However, this teaching does not show how to optimize the slits relative to each other, or relative to the rest of the dispensing opening. Examples of such attempts in the art include U.S. Pat. Nos. 4,526,291 issued Jul. 2, 1985 to Margulies, and 5,219,421 issued Jun. 15, 1993 to Tipping.

It is apparent there is a need in the art for a lightweight, portable disposable tissue package which provides the convenience of pop-up dispensing. It is further apparent there is a need in the art for a tissue package to allow for pop-up dispensing of tissues, but yet prevents the tissues from falling back through the dispensing opening. It is further apparent in the art there is a need for a relatively tall package which allows pop-up dispensing without allowing the tissues to fall back through the dispensing opening.

SUMMARY OF THE INVENTION

Figure 1:
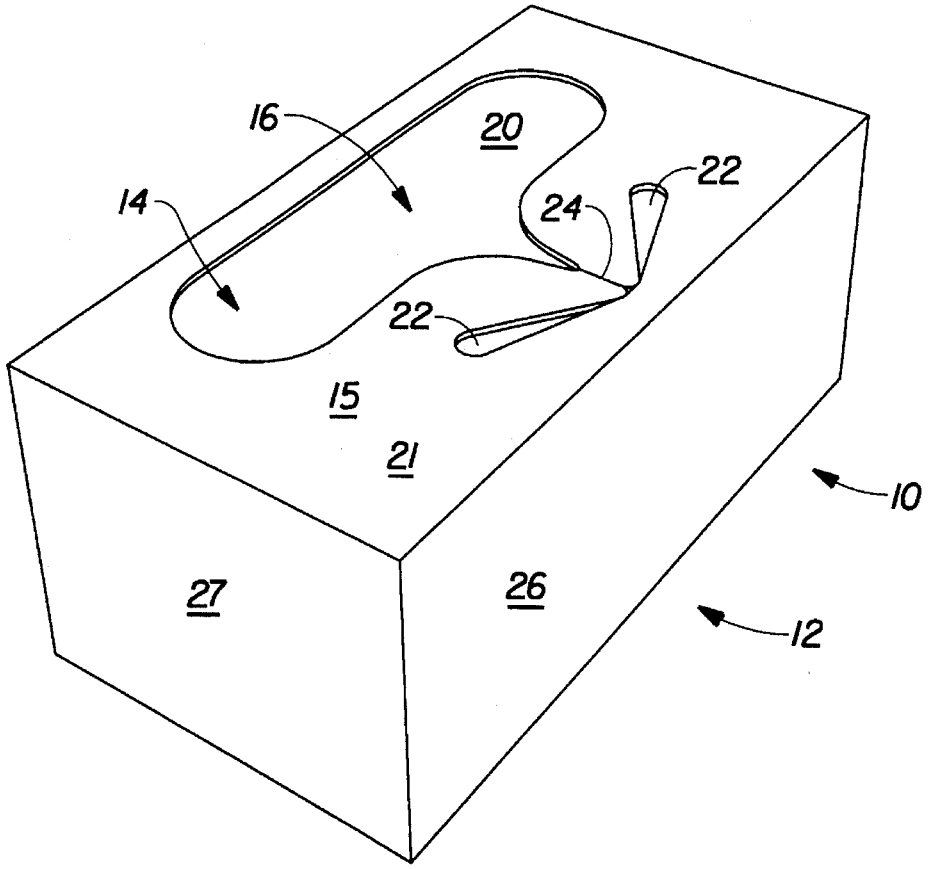
FIG. 1 is a perspective view of a dispensing package and tissues according to the present invention.

The invention comprises a dispensing opening for a magazine of tissues. The dispensing opening comprises a large first aperture and a second smaller aperture spaced apart from the first aperture. The first aperture and second aperture are connected by an isthmic connection and are in communication with one another. The isthmic connection has two opposed ends, one end being juxtaposed with each of the apertures. The isthmic connection may comprise a slit. The large first aperture may have a tapered side with an apex, which apex may be juxtaposed with one end of the isthmic connection. The smaller second aperture may be tapered, whereby the sides of the second aperture converge as they approach the end of the isthmic connection juxtaposed with the second aperture. The second aperture may be generally arcuate and oriented concave towards the end of the isthmic connection which is juxtaposed with the second aperture. More particularly, the second aperture may comprise two segments, each segment being a mirror image of the other and symmetric about the end of the isthmic connection juxtaposed with the second aperture.

A user can at least partially dispense a first tissue through the first large aperture. The first tissue is releasably attached to a second, or adjacent succeeding tissue. The user can then transfer all or part of the first tissue through the isthmic connection to the second and smaller aperture, then withdraw the first tissue through the dispensing opening. The first tissue is then separated from the second tissue. The second tissue, having been separated from the first tissue, will remain at least partially within the second aperture.

In another execution, the invention comprises a tissue package comprising a dispensing package and tissues in combination. The tissue package comprises a dispensing package having at least one generally planar wall. A dispensing opening is disposed on the generally planar wall. The dispensing opening comprises two spaced apart apertures, a first larger aperture and a second smaller aperture, the first and second apertures being connected by an isthmic connection. The isthmic connection is formed by two lobes in the generally planar wall, with one lobe being on either side of the isthmic connection. Each lobe is cantilevered from a fixed end and extends to a free end which is distal from the fixed end, such that the free ends of the lobes define the sides of the isthmic connection.

A magazine of tissues is disposed in the dispensing package. Each tissue is releasably attached to an adjacent tissue. The first tissue may be dispensed through the larger first aperture by the user, and at least partially transferred through the isthmic connection to the second aperture. The first tissue is then withdrawn from the tissue package and easily separated from the adjacent tissue. The adjacent tissue remains in substantially the same position relative to the dispensing opening after separation from the first tissue.

DETAILED DESCRIPTION OF THE INVENTION

Referring to FIG. 1, the tissue package 10 according to the present invention comprises a dispensing package 12 and releasably attached tissues 14 in combination. The dispensing package 12 may have walls and be generally parallelepipedly shaped. The dispensing package 12 has at least one generally planar wall 15 with a dispensing opening 16 therein. A plurality of tissues 14 are disposed in the dispensing package 12.

Examining the dispensing package 12 in more detail, it may have separate walls. The walls preferably define a top 21, a bottom, front and back sides 26, and left and right sides 27. Preferably the dispensing opening 16 intercepts the top 21, which can be coincident the aforementioned generally planar wall 15.

The height of the dispensing package 12 is typically an issue only if the breaking strength of the releasable attachment means is overcome by the weight of the tissue 14 between the releasable attachment means and the magazine of tissues 14 therebelow. As the dispensing package 12 becomes taller in the vertical direction, and the weight of the free hanging tissue 14 increases, the dispensing opening 16 must become more restrictive to prevent the tissue 14 to be dispensed from falling back into the dispensing package 12. Furthermore, as the tissues 14 become thicker, the area of the dispensing opening 16 should increase to allow the tissues 14 to be dispensed therethrough.

A suitable dispensing package 12 may be made in accordance with the teachings of commonly assigned U.S. Pat. Nos. 4,623,074 issued Nov. 18, 1986 to Dearwester, or 5,379,897 issued Jan. 10, 1995 to Muckenfuhs et al., which patents are incorporated herein by reference, it being noted that the dispensing openings of the aforementioned patents are not suitable for nor illustrative of the dispensing opening 16 according to the present invention.

The tissue package 10 according to the present invention can be either disposable or refillable. By "disposable" is meant the dispensing package 12 is intended to be discarded after the plurality of tissues 14 supplied therewith is depleted. The dispensing package 12 is not intended to be restocked with tissues 14. Likewise, each tissue 14 is discarded after use, and is not laundered, or otherwise restored. By "refillable" it is meant the dispensing package 12 is or may be restocked with tissues 14 after the supply is depleted.

The tissue package 10 may also be lightweight. By "lightweight" it is meant the dispensing package 12 is conveniently portable and does not have dead weight specifically added thereto.

The dispensing opening 16 is of a first size relative to the tissues 14. This first size is designed to constrict the tissues 14 as they are pulled through the dispensing opening 16 by the user. Tissues 14 are considered to be "constricted" when they must touch the walls 15, 21 intercepted by the dispensing opening 16 upon withdrawal by the user.

Suitable tissues 14 may be made according to commonly assigned U.S. Pat. No. 4,191,609 issued Mar. 4, 1980 to Trokhan, or U.S. Pat. No. 5,332,118 issued Jul. 26, 1994 to Muckenfuhs, the disclosures of which are incorporated herein by reference for the purpose of showing how to make tissues 14 suitable for use with the present invention. It is to be understood that the tissues 14 may either be wetted, or dry. One skilled in the art will recognize that the dispensing package 12 will be water impervious if the tissues 14 are wetted.

A tissue 14 is considered to have been "dispensed through" the dispensing opening 16 when it passes at least partially from inside the dispensing package 12 to outside the dispensing package 12, either due to the consumer reaching in and grasping the tissue 14, or the tissue 14 popping up through the dispensing opening 16, by trailing the tissue 14 previously withdrawn by the user. A tissue 14 is considered to be "withdrawn" after it has passed completely from inside the dispensing opening 16 to outside the dispensing opening 16, and no portion or edge of the tissue 14 remains within the dispensing package 12.

Figure 2:
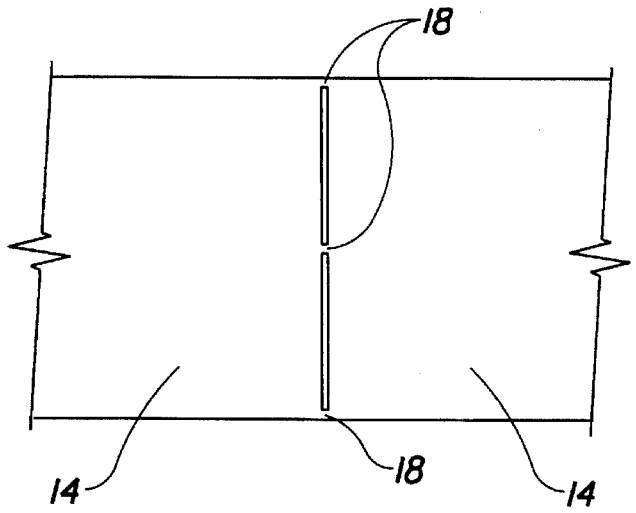
FIG. 2 is a plan view of adjacent tissues releasably attached by three frangible lands.

Referring to FIG. 2, each tissue 14 is releasably attached to both adjacent tissues 14 by any releasable attachment means which allows easy separation to occur as the tissue 14 is being dispensed or after the tissue 14 is withdrawn through the dispensing opening 16. The releasable attachment means may comprise adhesively joining the tissue 14 to the adjacent tissues 14 with skin friendly adhesive. A suitable adhesive is supplied by Findley Adhesives Inc. of Wauwatosa, Wis. as Item No. H9087-05. "Releasably attached" means each tissue 14 is easily separated from adjacent tissues 14, and may include releasable attachment means, such as friction, cohesion, or other forces which releasably attach adjacent tissues 14.

Preferably, each tissue 14 is releasably attached to an adjacent tissue 14 by a plurality of frangible lands 18. As used herein a "land" refers to a small connection separated by large cuts and joining adjacent tissues 14. Lands 18 are considered to be "frangible" if, upon separation of one tissue 14 from an adjacent tissue 14 in tension, the lands 18 break prior to significant ripping or tearing of either tissue 14.

The tissues 14 may be connected by a plurality of lands 18. In a particularly preferred embodiment, adjacent tissues 14 are releasably attached by three spaced apart frangible lands 18, a central land 18 and two outboard lands 18. One of each of the outboard lands 18 is juxtaposed with an edge of the tissue 14. The central land 18 is between the outboard lands 18, and is preferably centrally located relative to the outboard lands 18. The three land 18 arrangement provides control of both the center and each of the ends of the tissue 14, with a minimum of tensile force necessary to separate one tissue 14 from an adjacent tissue 14.

Figure 3:
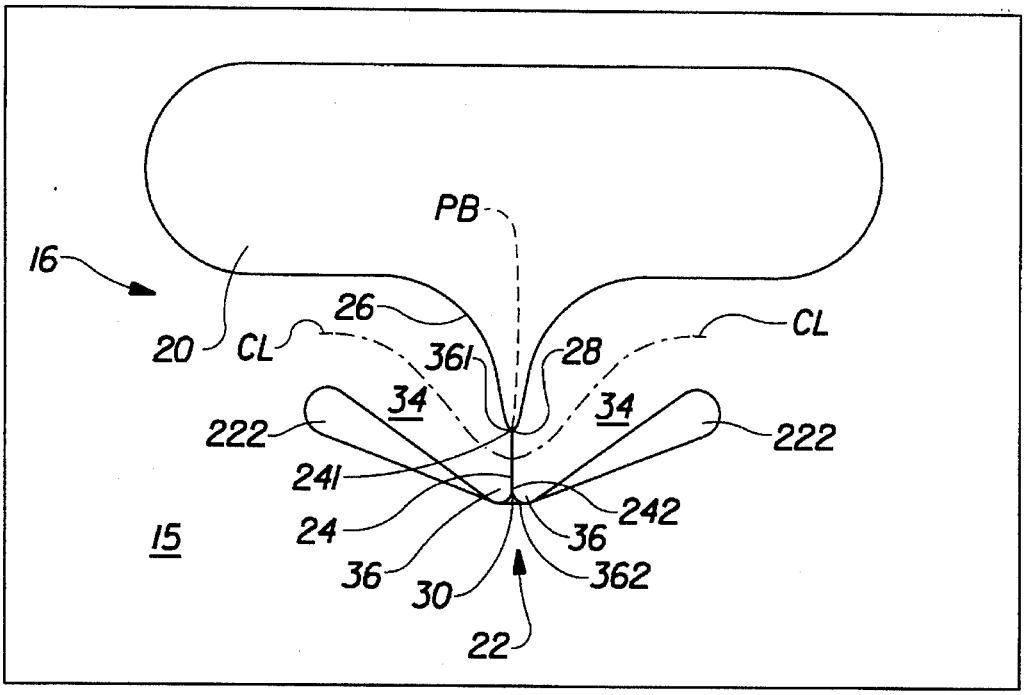
FIG. 3 is a plan view of a first embodiment of a dispensing opening according to the present invention.

Referring to FIG. 3, the dispensing opening 16 comprises first and second spaced apart apertures 20, 22 connected by an isthmic connection 24. The isthmic connection 24 allows communication of tissues 14 from the first aperture 20 to the second aperture 22 and vice versa. The first aperture 20 is larger in area than the second aperture 22. A suitable first aperture 20 may be generally rectangularly shaped, having dimensions of about 10 centimeters by about 3 centimeters. The first aperture 20 may be juxtaposed with the long edge of the dispensing package 12 as shown, the short edge of the dispensing package 12, a corner thereof, or be disposed in any other suitable position as desired.

The first and larger aperture 20 may have a tapered side 26. The tapered side 26 terminates at an apex 28. This arrangement allows a tissue 14 grasped through the large aperture 20 by the user to be funneled through the taper 26 towards the apex 28. In this manner, the tissue 14 can be threaded from the large aperture 20 through the isthmic connection 24 towards the smaller aperture 22. If the tissue package 10 has a hinged lid, preferably the tapered side 26 of the first aperture 20 is oriented away from the hinge of such lid. This arrangement allows the tissue 14 to be pulled laterally, in a direction having a vector component parallel to the generally planar wall 15, so that the tissue 14 is not withdrawn through the large aperture 20 and then separated from an adjacent tissue 14. If a tissue 14 is separated from an adjacent tissue 14 without at least partially intercepting the isthmic connection 24 and/or second aperture 22, the succeeding tissue 14 will most likely fall back into the dispensing package 12 and have to be inconveniently retrieved by the user.

If the first aperture 20 has a tapered side 26, preferably the isthmic connection 24 intercepts the first aperture 20 at the tapered side 26, and more preferably at the apex 28 of the tapered side 26. This arrangement is critical, in that it allows the user to more conveniently and accurately funnel the tissue 14 from the first aperture 20 to the second aperture 22. The arrangement shown in the figures is a generally preferred embodiment wherein the isthmic connection 24 and apex 28 are generally colinear where the isthmic connection 24 intercepts the apex 28. The isthmic connection 24 is considered to be "colinear" with the tapered side 26 when, at the apex 28, the perpendicular bisector PB of the tapered side 26 of the first aperture 20 and the isthmic connection 24 are generally parallel. This arrangement is critical because it allows a more natural transition of a tissue 14 as it is transferred from the first aperture 20 into the isthmic connection 24, for subsequent transfer to the second aperture 22.

Examining the isthmic connection 24 in more detail, it has two opposed ends 241, 242. The first end 241 of the isthmic connection 24 is juxtaposed with the first aperture 20. If the first aperture 20 has a tapered side 26, the first end 241 of the isthmic connection 24 is juxtaposed with the first aperture 20 where the isthmic connection 24 intercepts the apex 28. Preferably the isthmic connection 24 is relatively short, and more preferably straight, so that tissues 14 are not ripped or separated while being transferred through the isthmic connection 24.

The isthmic connection 24 may comprise a slit. A "slit" refers to a severing between two otherwise contiguous pieces of material, wherein the opposite sides of the slit are touching, the slit having not been formed by removal of the material. Alternatively, and less preferably, the isthmic connection 24 may comprise a narrow passageway wherein opposite sides do not touch.

The second end 242 of the isthmic connection 24 is juxtaposed with the second aperture 22, so that tissues may be transferred from the first aperture 20 to the second aperture 22 via the isthmic connection 24.

If the second aperture 22 is irregularly shaped, or has a portion which is more restrictive to tissues 14 being dispensed therethrough, preferably the second end 242 of the isthmic connection 24 intercepts the second aperture 22 at such a more restrictive portion, to prevent the tissue 14 from falling back into the dispensing package 12.

Examining the second aperture 22 in more detail, it may have any suitable shape, and is smaller in area than the larger first aperture 20. It is critical that the second aperture 22 be smaller in area than the first aperture 20, so that tissues 14 which are dispensed from the tissue package 10, after the first tissue 14 has been withdrawn, do not fall back into the dispensing package 12. The first aperture 20 only serves to allow the user to grasp the tissue 14 closest to the dispensing opening 16.

The second aperture 22 may be generally arcuate in shape. As used herein, a "arcuate" shape refers both to nonaxissymmetric shapes having a border made by curvilinear elements and to nonaxissymmetric shapes having a border made by relatively short rectilinear elements which are contiguous and abutted at an angle to resemble a generally curvilinear outline, which shapes resemble an arc.

The arcuately shaped second aperture 22 may be oriented concave towards the isthmic connection 24, and more particularly concave towards the second end 242 of the isthmic connection 24 which is juxtaposed with the second aperture 22. It will be recognized by one skilled in the art that if the isthmic connection 24 is relatively short, and the first aperture 20 is disposed entirely oppositely the isthmic connection 24 and away from the second aperture 22, the arcuate second aperture 22 may also be concave towards the apex 28 of the tapered side 26 of the first aperture 20.

This arrangement is critical for proper dispensing of the tissues 14, and particularly for tissues 14 joined by a plurality of lands 18. As the tissues 14 are withdrawn through the second aperture 22, the convex side of the second aperture 22 provides a smoother action, preventing premature separation of the first tissue 14 from the adjacent tissue 14. Once the adjacent succeeding tissue 14 has been at least partially dispensed through the second aperture 22, then the second tissue 14 may be easily separated from the first tissue 14.

The second aperture 22 may be bisected into two segments 222. Each of the two segments 222 may be a mirror image of the other and may be symmetrically opposite about and bisected by the isthmic connection 24 or an extension thereof. If the isthmic connection 24 is irregularly shaped, then preferably the two segments 222 of the second aperture 22 are symmetric about the end 242 of the isthmic connection 24 juxtaposed with the second aperture 22.

Preferably the sides of each segment 222 of the second aperture 22 converge towards the second end 242 of the isthmic connection 24. More preferably, the sides of each segment 222 of the second aperture 22 converge to a point 30 as the second end 242 of the isthmic connection 24 is approached. This arrangement is critical because it provides for three point contact 30 at a single point, as discussed below, where the isthmic connection 24 is coincident with the convergence of the two segments 222 of the second aperture 22.

The isthmic connection 24 may be defined by two lobes 34 in the generally planar wall 15. One lobe 34 is on each side of the isthmic connection 24. The lobes 34 are cantilevered from a fixed end and extend to a free end 36 which is distal from the fixed end of the lobes 34. The free end 36 of the lobes 34 define the isthmic connection 24. The lobes 34 are preferably tapered, so that the cross section of the lobes 34 decreases as the isthmic connection 24 is approached, the cross section being taken in a plane parallel to the isthmic connection 24.

The free end 36 of each lobe 34 has two lobe side ends 361, 362, juxtaposed with the first aperture 20 and the second aperture 22 respectively. If the first aperture 20 has a tapered side 26, the first lobe side end 361 is preferably juxtaposed with the tapered side 26, and more preferably with the apex 28 of the tapered side 26. Likewise, the second lobe side end 362 is juxtaposed with the second aperture 22. If the second aperture 22 has two segments 222, the second lobe side end 362 is preferably intermediate the two segments 222.

The lobes 34 are preferably mutually noncolinear. By "mutually noncolinear" it is meant that the centerlines CL of the lobes 34 intersect at an angle at a point coincident or between the free ends 36 of the lobes 34. The "centerline" of the lobe 34 is the line which has an endpoint on the free end 36 centered halfway between the lobe side ends 361, 362. The centerline CL extends towards the fixed end of the lobe 34 and is disposed at all times midway between the first and second apertures 20, 22. The mutual noncolinearity of the lobes 34 is determined at the free ends 36 thereof, or an extension of the centerlines CL if the free ends 36 of the lobes 34 are not adjacent. If the lobes 34 are not coplanar, the centerlines CL of the lobes 34 are projected to a common plane so that mutual noncolinearity may be determined.

If the sides of the segments 222 of the second aperture 22 converge to a common point 30, even more preferably the second lobe side end 362 is coincident the common point 30 where the segments 222 of the second aperture 22 converge.

This common point 30 may further be coincident the second end 242 of the isthmic connection 24. This arrangement is critical in providing three point contact 30 so that a tissue 14 to be dispensed does not fall back into the dispensing package 12. The tissue 14 is captured between at least one of the lobes 34 and at least one of the segments 222 of the dispensing opening, minimizing the chances of it falling back into the dispensing package 12.

This arrangement further ensures that a tissue 14 partially transferred through the isthmic connection 24 and into the second aperture 22 is concurrently disposed in both segments 222 of the second aperture 22 and the isthmic connection 24, thereby firmly holding the second tissue 14 in place, even after this tissue 14 has been separated from the preceding tissue 14.

Preferably the lobes 34 are integral with the generally planar wall 15. By "integral" it is meant that the lobes 34 are manufactured at the same time and from the same material as the generally planar wall 15, rather than being later attached thereto as separate components. This arrangement allows each lobe 34 to act as a spring, and independently of the other lobe 34, so that the lobes 34 may flex in response to dispensing of tissues 14 through the isthmic connection 24 or the second aperture 22.

In operation, tissues 14 may be dispensed from the tissue package 10 according to the following procedure. The user inserts his or her fingers through the first aperture 20, and partially dispenses a first tissue 14 therethrough. The first tissue 14 is at least partially transferred from the first aperture 20, through the isthmic connection 24, to the second aperture 22. One skilled in the art will understand that the transfer may not be complete because the tissue 14 is larger in area than either the isthmic connection 24 or the second aperture 22, and in fact, typically, is larger than the first aperture 20. The first tissue 14 is withdrawn from the tissue package 10 through the isthmic connection 24 and second aperture 22. The first tissue 14 is then separated from the adjacent or succeeding tissue 14. The first tissue 14 may be separated by breaking frangible lands 18, overcoming the adhesive forces if the tissues 14 are adhesively joined, or exceeding the tensile strength of any other releasable attachment means which may be selected.

Figure 4:
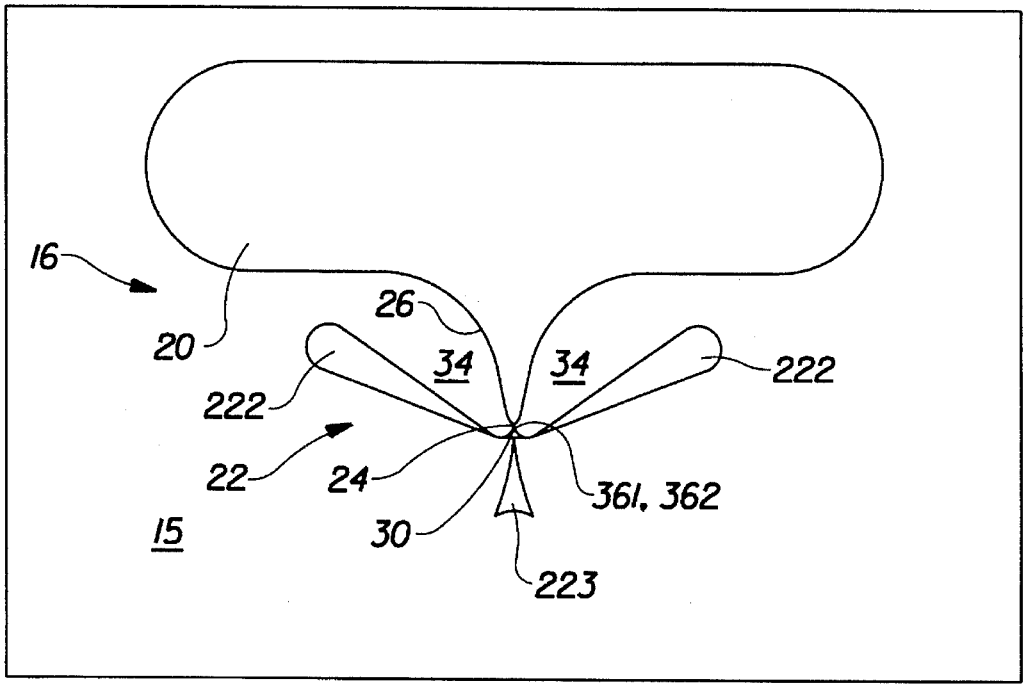
FIG. 4 is a plan view of a second embodiment of a dispensing opening according to the present invention wherein the isthmic connection comprises a single point.

Several variations are possible with the present invention. For example, referring to FIG. 4, the first aperture 20 may have a tapered side 26 with an apex 28 directly connected to the second aperture 22. In this arrangement, the isthmic connection 24 is simply the point of connection between the free ends 36 of the lobes 34. This arrangement may be visualized by tapering each of the lobes 34 until the first and second lobe side ends 361,362 converge to a single point at the free end 36 of the lobe 34.

The second aperture 22 may be provided with more than two segments 222. This arrangement simply provides an additional segment, such as illustrated by 223, through which portions of the tissue 14 may be dispensed, and does not detract from the importance of having portions of the second aperture 22 converge towards the point 30 of tangency between the second end 242 of the isthmic connection 24 and the second aperture 22.

Figure 5:
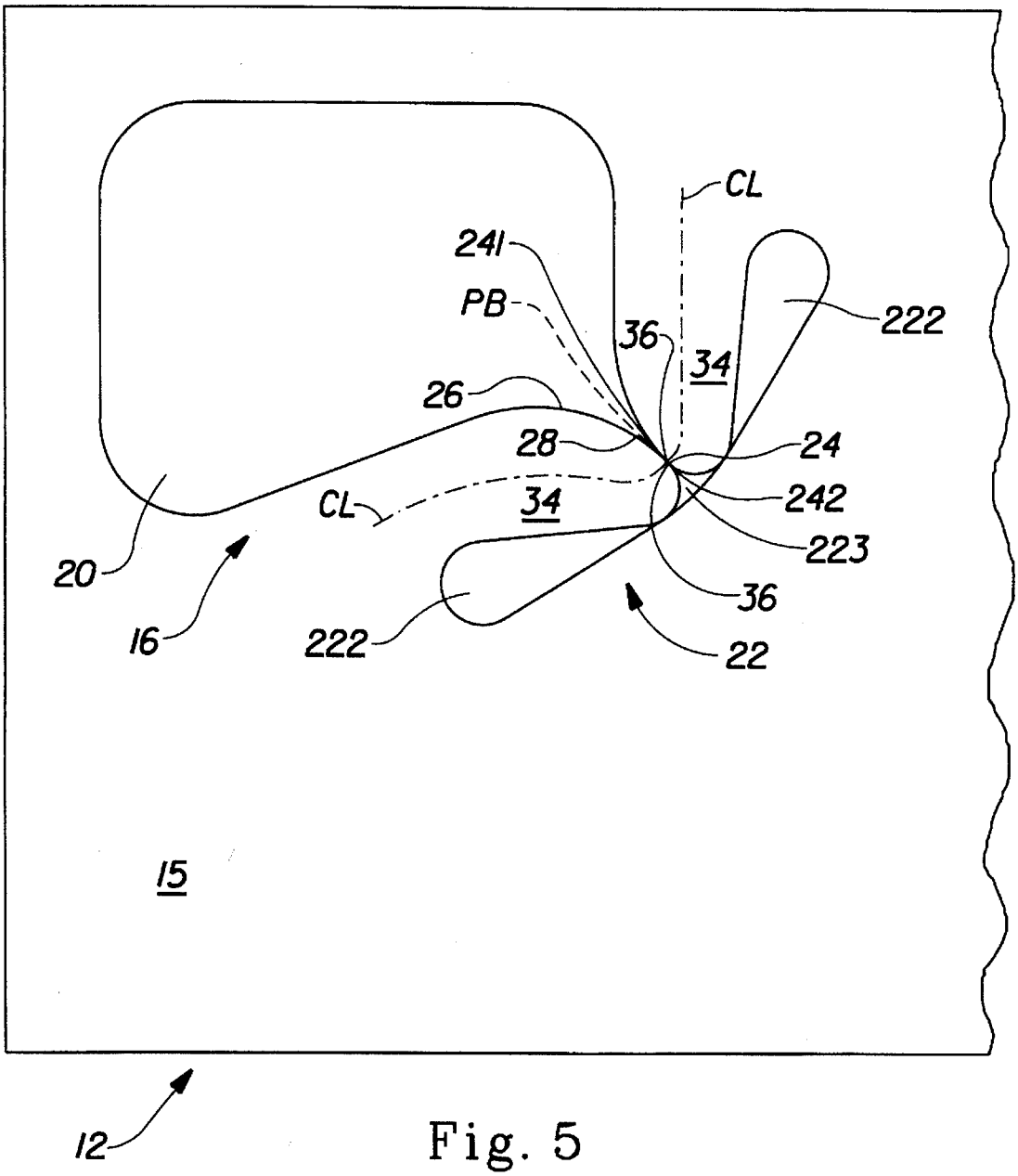
FIG. 5 is a plan view of a third embodiment of a dispensing opening according to the present invention wherein the lobes do not converge to a common point.

Referring to FIG. 5, the dispensing opening 16 need not be juxtaposed with the longer edge of the dispensing package 12. The dispensing opening 16 may be juxtaposed with the shorter edge of the dispensing package 12, a corner thereof, or in any other suitable configuration, including the front, back, or side walls 26, 27.

As illustrated in FIG. 5, the first aperture 20 can be asymmetrically shaped relative to the perpendicular bisector PB of the apex 28. Additionally, the free ends of the lobes 34 need not converge to a common point 30. Such an arrangement provides an isthmic connection 24 which intersects the large aperture 20 at the first end 241, and the small aperture 22 at the second end 242.

Such an arrangement provides a second aperture 22 comprising three distinct segments 222, 223 wherein a central segment 223 is interposed between two larger segments 222 outboard thereof. This arrangement has the advantage that each lobe 34 contacts the other lobe 34 and independently contacts the side of the second aperture 22. Each lobe 34 contacts the side of the second aperture 22 at a position spaced apart from where the other lobe 34 contacts the side of the second aperture 22. This arrangement has been found to be beneficial.

All such variations are within the scope of the appended claims.

What is claimed is:

1. A dispensing opening for a magazine of tissues and tissues in combination therewith, said dispensing opening comprising:

a first large aperture, said large aperture having a tapered side with an apex, said apex being contiguous with and in communication with an isthmic connection, said isthmic connection having two opposed ends, one said end juxtaposed with said apex, the other said end being juxtaposed with a nonaxissymmetric arcuate second aperture, said second aperture being smaller in area than said first aperture, said second aperture being tapered whereby the sides of said second aperture converge as they approach said end of said isthmic connection juxtaposed with said second aperture, whereby a user can at least partially dispense a first tissue through said first large aperture, said tissue being releasably attached to a second tissue, transfer all or a part of said first tissue through said isthmic connection to said second aperture, withdraw said first tissue through said dispensing opening, separate said first tissue from said second tissue, said second tissue remaining at least partially within said second aperture after being separated from said first tissue.

2. A dispensing opening for a magazine of tissues and tissues in combination therewith, according to claim 1, wherein said isthmic connection and said apex are generally colinear at the point of tangency where said isthmic connection intercepts said apex.

3. A dispensing opening for a magazine of tissues and tissues in combination therewith, according to claim 2, wherein said isthmic connection comprises a slit.

4. A dispensing opening for a magazine of tissues and tissues in combination therewith, according to claim 1, wherein said second aperture has a generally curvilinear border.

5. A dispensing opening for a magazine of tissues and tissues in combination therewith, according to claim 4, wherein said second aperture is oriented concave towards said end of said isthmic connection juxtaposed with said second aperture.

6. A dispensing opening for a magazine of tissues and tissues in combination therewith, according to claim 5 wherein said second aperture comprises two segments, each said segment being a mirror image of the other, said segments of second aperture being symmetric about said end of said isthmic connection juxtaposed with said second aperture.

7. A dispensing opening for a magazine of tissues and tissues in combination therewith, according to claim 4, wherein said second aperture is oriented concave towards said apex.

8. A tissue package comprising a dispensing package and tissues in combination, said tissue package comprising:

a dispensing package for holding tissues therein and having a generally planar wall, a dispensing opening being disposed on said generally planar wall, said dispensing opening comprising two spaced apart apertures, a first larger aperture and a second smaller aperture, said first aperture and said second apertures being connected by an isthmic connection, said isthmic connection being formed by two lobes in said generally planar wall, one said lobe being on either side of said isthmic connection, each said lobe being cantilevered from a fixed end and extending to a free end distal from said fixed end, said lobes being mutually noncolinear, said free ends of said lobes defining the sides of said isthmic connection; and a magazine of tissues in said dispensing package, each tissue being releasably attached to an adjacent tissue, whereby a first tissue may be dispensed through said first aperture by a user, at least partially transferred through said isthmic connection to said second aperture, then be withdrawn from said tissue package and easily separated from said adjacent tissue, said adjacent tissue remaining in substantially the same position relative to said dispensing opening after being separated from said first tissue.

9. A tissue package according to claim 8 wherein lobes are tapered, said lobes converging towards said free end.

10. A tissue package according to claim 9 wherein said second aperture is generally arcuately shaped, and said isthmic connection has two ends, a first end juxtaposed with said first aperture, and a second end juxtaposed with said second aperture, said second aperture being oriented concave towards said second end of said isthmic connection.

11. A tissue package according to claim 10 wherein said second aperture comprises two segments, each said segment being a mirror image of the other, said segments of said second aperture being symmetric about said second end of said isthmic connection, the sides of each said segment of said second aperture converging to a common point, said common point being coincident said second end of said isthmic connection is approached.

12. A tissue package according to claim 11 wherein said free end of each said lobe has two opposed lobe side ends, a first lobe side end juxtaposed with said first aperture, and a second lobe side end juxtaposed with said second aperture, said second lobe side end being coincident said point where said segments of said second apertures converge, whereby a tissue partially transferred through said isthmic connection to said second aperture may be concurrently disposed in both said segments of said second aperture and said isthmic connection.

13. A tissue package according to claim 9 wherein said lobes are integral with said generally planar wall.

14. A tissue package according to claim 10 wherein each said tissue is releasably attached to an adjacent tissue by three spaced apart frangible lands, a central land and two outboard lands, one of each said outboard lands being juxtaposed with an edge of said tissue, said central land being between said outboard lands.

15. A tissue package according to claim 9 wherein each of said lobes is tapered to a single point at said free end of said lobe, the free end of each said lobe being juxtaposed with the free end of the other said lobe.

16. A tissue package according to claim 8 wherein each said lobe is juxtaposed with said other lobe at a first point, and wherein said second aperture is generally arcuately spaced, each said lobe further contacting a side of said arcuately spaced second aperture at a point spaced apart from where said other lobe contacts said side of said second aperture.

17. A method of dispensing tissues from a tissue package comprising a dispensing package and tissues in combination therewith, said method comprising the steps of:

providing a dispensing package having a generally planar wall, a dispensing opening being disposed on said generally planar wall, said dispensing opening comprising two spaced apart apertures, a first larger aperture and a second smaller aperture, said first aperture and said second apertures being connected by an isthmic connection, said isthmic connection being formed by two lobes in said generally planar wall, one said lobe being on either side of said isthmic connection, each said lobe being cantilevered from a fixed end and extending to a free end distal from said fixed end, said free ends of said lobes defining the sides of said isthmic connection, wherein said lobes are mutually noncolinear;

disposing a magazine of tissues inside said dispensing package, each said tissue being releasably attached to an adjacent tissue;

partially dispensing a first tissue from said dispensing package through said first aperture by reaching therethrough;

at least partially transferring said first tissue from said first aperture through said isthmic connection to said second aperture;

withdrawing said tissue from said tissue package; and separating said first tissue from said adjacent tissue, whereby said adjacent tissue does not fall back inside said dispensing package.

18. The method of claim 17 wherein each said tissue is releasably attached to an adjacent tissue by a plurality of frangible lands, and said first tissue is separated from said second tissue by breaking each of said frangible lands.

* * * * *

UNITED STATES PATENT AND TRADEMARK OFFICE

CERTIFICATE OF CORRECTION

PATENT NO. : 5,516,001

DATED : May 14, 1996

INVENTOR(S) : Delmar R. Muckenfuhs et al.

It is certified that error appears in the above-indentified patent and that said Letters Patent is hereby corrected as shown below:

Column 2, line 36 delete "cannon" and insert --carton--.

Signed and Sealed this

Fifteenth Day of April, 1997

Bruce Lehman

*Attest:*

BRUCE LEHMAN

*Attesting Officer*

*Commissioner of Patents and Trademarks*